US008434236B2

(12) United States Patent
Pellenc

(10) Patent No.: US 8,434,236 B2
(45) Date of Patent: May 7, 2013

(54) CHAIN SAW WITH TENSION ADJUSTMENT

(75) Inventor: Roger Pellenc, Petruis (FR)

(73) Assignee: Pellenc (Societe Anonyme), Pertuis (FR)

( * ) Notice: Subject to any disclaimer, the term of this patent is extended or adjusted under 35 U.S.C. 154(b) by 716 days.

(21) Appl. No.: 12/527,664

(22) PCT Filed: Feb. 25, 2008

(86) PCT No.: PCT/FR2008/000243

§ 371 (c)(1),
(2), (4) Date: Dec. 7, 2009

(87) PCT Pub. No.: WO2008/122715

PCT Pub. Date: Oct. 16, 2008

(65) Prior Publication Data

US 2010/0088905 A1 Apr. 15, 2010

(30) Foreign Application Priority Data

Feb. 26, 2007 (FR) ..... 07 01355

(51) Int. Cl.
*B27B 17/00* (2006.01)

(52) U.S. Cl.
USPC ..... 30/381; 30/386

(58) Field of Classification Search ..... 30/381–387
See application file for complete search history.

(56) References Cited

U.S. PATENT DOCUMENTS

| | | | | | |
|---|---|---|---|---|---|
| 2,765,821 | A * | 10/1956 | Strunk | 30/386 |
| 3,194,284 | A * | 7/1965 | Walker | 30/386 |
| 3,382,898 | A | 5/1968 | Walker | |
| 3,636,995 | A | 1/1972 | Newman | |
| 3,866,320 | A * | 2/1975 | Progl | 30/386 |
| 4,223,438 | A * | 9/1980 | Kerrison | 30/386 |
| 4,316,327 | A * | 2/1982 | Scott et al. | 30/386 |
| 4,382,334 | A * | 5/1983 | Reynolds | 30/386 |
| 4,835,868 | A * | 6/1989 | Nagashima | 30/386 |
| 5,528,835 | A * | 6/1996 | Ra | 30/386 |
| 6,389,700 | B2 * | 5/2002 | Paquin | 30/382 |
| 6,539,832 | B1 * | 4/2003 | Nilsson | 30/386 |
| 6,694,623 | B1 * | 2/2004 | Haughey | 30/386 |
| 7,107,689 | B2 * | 9/2006 | Keeton et al. | 30/386 |
| 7,185,437 | B2 * | 3/2007 | Behbahany | 30/386 |
| 7,434,502 | B2 * | 10/2008 | Keeton et al. | 30/386 |
| 7,481,000 | B2 * | 1/2009 | Tynes et al. | 30/386 |
| 7,600,323 | B2 * | 10/2009 | Sugishita | 30/386 |

(Continued)

FOREIGN PATENT DOCUMENTS

| | | |
|---|---|---|
| AU | 2008235391 A1 * | 10/2008 |
| CA | 2679075 A1 * | 10/2008 |

(Continued)

*Primary Examiner* — Jason Daniel Prone
(74) *Attorney, Agent, or Firm* — Egbert Law Offices, PLLC

(57) ABSTRACT

A chain saw apparatus has a body, a guide bar extending from the body, a drive sprocket rotatably mounted to the body, a chain affixed to the drive sprocket and to the guide bar, an engagement device positioned on the body and cooperative with the guide bar so as to allow the guide bar to move toward and away from the body, and pushing device for automatically moving the guide bar away from the drive sprocket. The pushing device has a slide and an elastic component. The slide bears against a rear end of the guide bar. The elastic component urges between the body and the slide.

15 Claims, 8 Drawing Sheets

U.S. PATENT DOCUMENTS

| | | | | |
|---|---|---|---|---|
| 7,743,513 | B1 * | 6/2010 | Fisher et al. | 30/386 |
| 2009/0007439 | A1 * | 1/2009 | Sugishita | 30/386 |
| 2009/0241353 | A1 * | 10/2009 | Ericson et al. | 30/386 |
| 2010/0146801 | A1 * | 6/2010 | Pellenc | 30/386 |
| 2010/0293797 | A1 * | 11/2010 | Fisher et al. | 30/386 |
| 2011/0308096 | A1 * | 12/2011 | Yu et al. | 30/386 |
| 2011/0314682 | A1 * | 12/2011 | Maag et al. | 30/386 |
| 2012/0066917 | A1 * | 3/2012 | Okouchi | 30/386 |

FOREIGN PATENT DOCUMENTS

| | | | | |
|---|---|---|---|---|
| CN | 101668619 | A | * | 3/2010 |
| EP | 1637299 | | | 3/2006 |
| EP | 1961530 | A1 | * | 8/2008 |
| EP | 1961531 | A1 | * | 8/2008 |
| ES | 2385815 | T3 | * | 8/2012 |
| FR | 2912949 | A1 | * | 8/2008 |
| JP | 07314402 | | | 12/1995 |
| JP | 2010519076 | A | * | 6/2010 |
| KR | 20100014655 | A | * | 2/2010 |
| MX | 2009009058 | A | * | 1/2010 |
| PT | 1961530 | E | * | 6/2012 |
| RU | 2009135791 | A | * | 4/2011 |
| WO | WO 2008122715 | A1 | * | 10/2008 |

* cited by examiner

CHAIN SAW WITH TENSION ADJUSTMENT

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention concerns a chain saw equipped with a device for adjusting the tightness of the cutting chain.

2. Description of Related Art

Including Information Disclosed Under 37 CFR 1.97 and 37 CFR 1.98.

Such chain cutting tools are usually called chain saws and are commonly used to cut various materials (wood, concrete, bricks, tiles, etc.). They include a cutting device constituted by an endless cutting chain turning around a drive sprocket and a chain guide generally of an oblong shape and equipped with a peripheral guide bar and a power source for the drive of this chain by means of said sprocket. To perform a satisfactory and safe job, it is indispensable for the chain to be perfectly tensioned. As a matter of fact, when this chain is loose, it represents a major risk of jumping off the sprocket and breaking, thereby putting the operator at risk of injury. On the other hand, when the chain is too tight, this results in faster wear of the chain and the guide bar, abnormal overheating of both the chain and the guide bar, higher energy consumption and loss of efficiency of the cutting device that could lead to its seizing up.

On account of the fact that the chain slackens by itself due to the wear of the chain pins while the chain is in use, adjustment of its tension cannot be made once and for all but must instead be repeated regularly, whenever said chain becomes loose. This is a delicate and complicated operation because it is difficult for the operator to determine and to obtain the tension that is just right.

Numerous devices have been offered to date for adjusting the tension of the cutting chain, which requires removal of the guide bar which tends to move further away from the drive sprocket. However, none of these devices permits a satisfactory automatic adjustment of this tension. In general the adjustment principle for the tension means actuating a tensioning device parallel to the guide bar.

These known devices require much experience to obtain an adjustment to the proper tension, and, in spite of such experience, a good adjustment is not always assured.

BRIEF SUMMARY OF THE INVENTION

It is the particular aim of the invention to allow automatic adjustment of the tension of the cutting chain of chain saws and also to facilitate obtaining this automatic adjustment. The invention also aims at making the operation of chain replacement easier whenever this turns out to be desirable.

The invention refers to a chain saw which includes a cutting device constituted by a cutting chain mounted so that it turns around a drive sprocket and a guide bar that can be immobilized on a body by means of an engagement device and which can be moved in two directions to either bring it closer to or further away from the drive sprocket in order to loosen the tension of the chain or to ensure its tension respectively. This chain saw is remarkable in that it comprises a pushing device which tends to automatically move the guide bar away from the drive sprocket when the engagement device is loosened. The pushing device is constituted, by a slide against the proximal end of which rests the proximal end of the guide bar, and by an elastic component, preferably consisting of a helical spring resting, with its opposed ends against a fixed element of the body and against a surface of the distal end of said slide.

In case of a relaxation of the tension of the chain previously mounted on the guide bar of the saw, it is clear that all one has to do is loosen and then re-tighten the engagement device in order to obtain a proper re-tensioning of the chain.

The particular advantages of the invention are:

- obtaining an automatic adjustment of the proper chain tension due to the pre-dimensioned and preset pushing device;
- simplicity of activation and rapidity of adjustment;
- no need for a specific tool;
- easily carried out with little or no experience; and
- safety, since the hands do not touch the chain.

According to another characteristic arrangement, the chain saw comprises a retractable retaining device, which automatically immobilizes the guide bar, in opposition to the counteraction of the elastic component of the pushing device, in a position where it finds itself closer to the drive sprocket. The release of this retaining device results automatically in the distancing of said guide bar in relation to said drive sprocket and the tensioning of the chain, under the action of the pushing device.

Because of this arrangement, removal of the worn chain and its replacement by a new chain can be performed easily, quickly and safely, with no risk of injury. The same goes for replacement of the guide bar or its reversal.

According to another characteristic arrangement, the pushing device and the retaining device of the guide bar form a functional assembly including a slide positioned below the proximal end of the guide bar. The proximal end of this slide is equipped with at least one, and preferably two stop-and-catch hooks against which rests the proximal end of the guide bar. The elastic component bears, at its distal end, against a surface of the distal end of the slide. A retractable retainer is mounted directly below said slide so as to automatically ensure the immobilization of the latter when it reaches the end of its backward motion.

The retractable retainer has an operating pin for pushing said retainer in and releasing the retainer device.

The operating pin of the retractable retainer is oriented in the direction of a cover fastened on the body of the apparatus and the length of the operating pin is such that the pin is automatically pushed in when said cover is put in place on the body. This is suitable for suppressing and effacing the retractable retainer and allowing the motion of the slide towards the front of the apparatus, under the action of the pusher.

The retractable retainer is subjected to the action of a pressure device advantageously formed by a helical spring intended to push it back into the slide blocking position.

The slide is maintained on the body of the saw by means of a guide shoe mounted at the end of a fastening rod attached to the body and crossing a longitudinal slot made in said slide. This guide shoe sits astride the edges of said slot, being so shaped as to ensure guidance without any noticeable play of the guide bar, during the longitudinal movements of the latter. More precisely, the part of the slot of the guide bar that is meant to slide on the shoe is of a width which allows the sliding of said guide bar without any noticeable play on the parallel sides of said shoe.

The body has a contact face against which the guide bar is pressed. This contact face has a recess into which the slide can move by means of one of its planar surfaces.

BRIEF DESCRIPTION OF THE SEVERAL VIEWS OF THE DRAWINGS

The invention will be better understood when reading the description below, given solely as an example and made with reference to the attached drawings.

DETAILED DESCRIPTION OF THE INVENTION

Reference to said drawings is made to describe an advantageous example of execution, although by no means limiting, of the chain saw in accordance with the invention.

This invention applies to any type of chain saw (hand-held chain saw, telescopic pole chain saw, etc.).

In the following and in the attached claims, the terms "before", "after", as well as similar terms refer to the position of the guide 4 and of the chain 2 in relation to the rest of the chain saw 1, considering that the guide 4 and the chain 2 project from the front of said chain saw 1.

Figure 1:
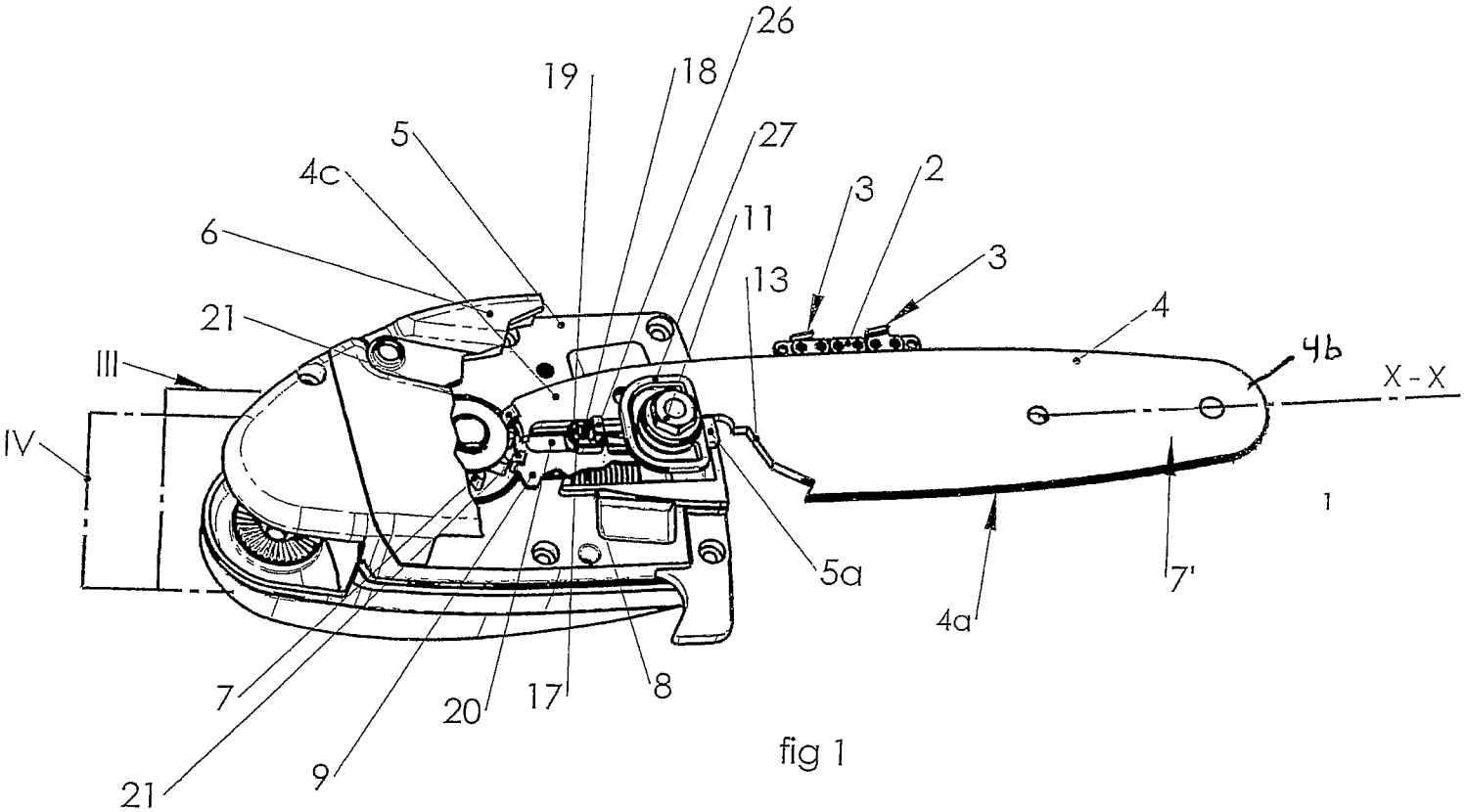
FIG. 1 is a perspective view of a chain saw in conformance with the invention.
Figure 2:
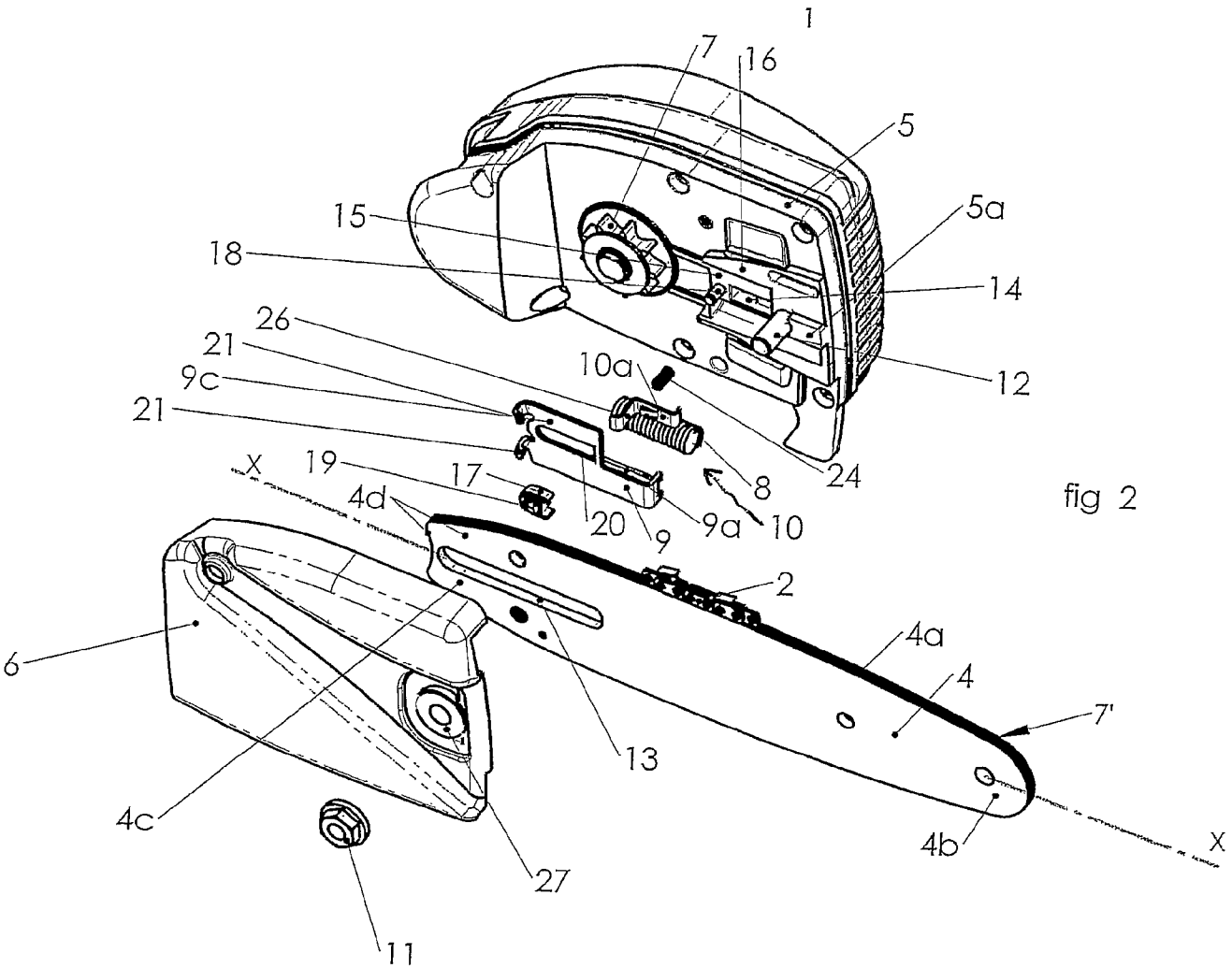
FIG. 2 is an exploded view, in perspective, of the chain saw shown in FIG. 1.
Figure 3:
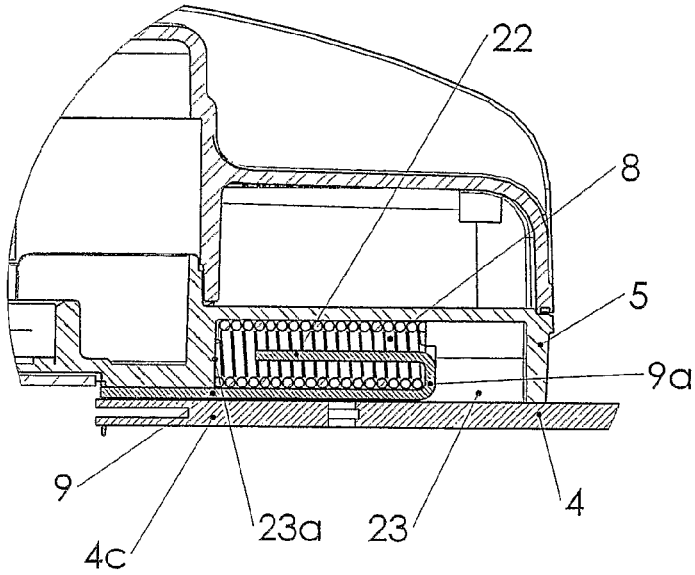
FIG. 3 is a sectional view along plane III of FIG. 1.

On FIGS. 1 and 2, a chain saw is shown which includes a cutting device comprising an endless cutting chain 2, turning around a drive sprocket 7 and a guide bar 4 generally of an oblong shape and equipped with a peripheral guide rail 4*a* of said chain and a return sprocket 7' positioned at the distal end or the front end 4*b* of this guide bar. A power source (not shown) is coupled to the drive sprocket 7. The power source can be an electric motor or a thermal engine. The power source ensures the drive of the cutting chain 2 by means of said drive sprocket 7. The articulated cutting chain is constituted in the known manner of drive links, cutter links 3 (or cutting teeth) and of side links interconnected by link pins and rivets.

In its proximal part or rear part 4*c*, the guide bar 4 is equipped with a longitudinal slot 13 allowing its guidance in translational motion during its movements in relation to the body 5. The forward end of the guide bar has guidance element consisting of a projection 5*a* which has two parallel sides against which the edges of said slot 13 can glide.

The guide bar 4 is mounted, through the intermediary of its proximal part 4*c*, between two elements. One of the elements is a cover 6 fixed on the body 5 through the intermediary of an engagement device allowing: either to immobilize the guide bar 4 on the body 5, or to permit the movements of said guide bar 4 towards the rear or forward, that is to say in two directions to bring it closer or to distance it further from the drive sprocket 7, so as to relax the tension of the chain 2 or to ensure its tension, respectively.

The engagement device (shown by reference numerals 11 and 12) allows to perform, at the same time, fixing and blocking the guide bar 4 on the body 5 and the fastening of the cover 6 on said body. The engagement device can have a threaded rod 12 affixed to the body 5 and a nut 11 which is screwed on the threaded end portion of said threaded rod. Advantageously, especially when the cover 6 is made of rigid plastic material, the cover may be equipped with a metallic grip housed with an ability for axial movement and retained in an opening made in a recess provided in said cover 6 so that it finds itself crossed by the threaded rod 12 of the engagement device during the installation of the cover 6 on the body 5. This grip 27 resting on a surface of the distal part 4*c* of the guide bar 4 allows a sturdy fixing of the guide bar 4 against the body 5 by screwing the nut 11 onto the threaded rod 12.

According to an important characteristic arrangement of the invention, a pushing device (shown generally by reference numerals 8 and 9) automatically pushes the guide bar forward, that is to say into a position moving it away from the drive sprocket 7 when the engagement device is loosened, so as to perform an automatic tensioning or re-tensioning of the chain 2.

Advantageously this pushing device includes a slide 9 and an elastic component. The proximal end of the slide 9 is equipped with a stop against which rests the proximal end 4*d* of the guide bar 4. The elastic component, preferably constituted by a helical spring 8 rests through the intermediary of its opposing ends on against a fixed component of the body 5, and against a surface 9*a* of the distal end of the slide 9.

This helical spring 8 has a length and stiffness or return force that is selected in order to obtain good tension of the chain 2, is fixed, through the intermediary of its opposite ends, against the proximal end or rear end 23*a* of a groove 23 made in the body 5 and in which is placed said spring, and against a distal surface 9*a* of the slide 9 resting, through the intermediary of its proximal part, against the distal end 4*d* of the guide bar 4. The groove 23 is made in the body 5, below the location where the slide 9 is mounted and parallel to the axis of movement of the slide.

The spring 8 can be slipped, by its distal part, over a rod 22 which is affixed with the distal end 9*a* of the slide 9 and which may be formed of a single piece with the slide. The rod extends towards the rear.

The chain saw features a retaining device which has a retractable retainer 10 which allows the automatic immobilizing of the guide bar 4, in opposition to the counteraction of the spring 8, in a position where it finds itself closer to the drive sprocket 7. The saw is also laid out so that the release of this retainer automatically leads to the forward movement of the guide bar 4 and the tensioning of the chain, under the action of the pusher.

The retractable retainer 10 forms, in its active blocking position, an obstacle, which a front edge of the slide 9 hits against.

Preferably the spring 8 and the retaining device 10 of the guide bar form a functional assembly including the slide 9 arranged below the proximal part 4*c* of the guide bar 4. The proximal end or the rear end of this slide is equipped with at least one stop-and-catch 21. The proximal end or the rear end 4*d* of the guide bar 4 rests against the stop-and-catch hooks. The spring 8 has a distal end bearing against a surface 9*a* of the distal end or front end of the slide 9, ensuring automatic immobilization of the slide 9 when it reaches the end of its backward movement.

The hook 21 or each hook 21 is constituted by a forward-bent grip to facilitate the assembly and disassembly operations of the guide bar 4. Due to this configuration, the hooks 21 allow the guide bar 4 to be lifted and tilted around a supporting point constituted by the bottom of said hooks, at an angle in the order of 45° from the mounting position of said guide bar. This facilitates the replacement of the chain and/or the guide bar.

The retractable retainer 10 is affixed to an operating pin 26. This permits the depression of said retainer and the release of the retaining device. Preferably, the operating pin 26 is made of a single piece together with the retractable retainer 10.

The operating pin 26 of the retractable retainer 10 is oriented in the direction of the cover 6 attached on the body 5. This operating pin 26 is of such a length that it is automatically depressed when the cover is placed on the body, so as to retract said retainer and to allow the movement of the slide 9 towards the front of the apparatus, under the action of the spring 8.

The retractable retainer is subject to the action of a helical spring 24 that tends to push it back into the blocking position of slide 9. This return spring 24 is, for example, slipped over a rod 25 that is affixed to the body 5 and it is engaged, by the intermediary of its opposite ends, against a fixed surface of said body, and against the rear surface of the mounting device 10*a* of said retractable retainer 10.

The retractable retainer 10 has an inclined position rising towards the rear in relation to the central plane face of the slide 9 and it is depressed into its recess 14 in opposition to the counteraction of the spring 24 when the slide 9 recedes. When the front edge 9*c* of the slide 9 passes the end 10*b* of the retainer 10, the retainer is pushed back by said spring 24 and places itself in front of said front edge. This prohibits any movement tending to move the slide 9 and the guide bar 4 away from the drive sprocket 7.

When the slide 9 is moved away from the sprocket 7, the retainer 10 is lodged in a slot 20 of said slide. When the slide recedes, the retainer is suppressed in its recess 14 by the force exerted by the small cross bar 9*d* located at the front end of said slot 13. When the small cross bar 9*d* passes the end 10*b* of the retainer 10, the retainer is pushed back by the spring 24 and places itself in front of said cross bar 9*d*, thus forming a stop thereby, prohibiting any movement tending to move the slide 9 and the guide bar 4 away from the drive sprocket 7, for instance, when changing the chain or the guide bar.

The body 5 features a contact face 16 against which the guide bar is engaged and this contact face is provided with a recess 15 into which the slide 9 can move through the intermediary of one of its planar faces. The opposite surface 9*e* of said slide is retracted in relation to said contact face 16. The slide 9 is guided, during its movements, by the longitudinal parallel edges of the recess or seat 15.

The slide 9 is maintained under the body 5 in its recess 15 by means of a shoe 17 mounted at the end of a rod 18, by means of an elastic retaining snap ring. The rod crosses the longitudinal slot 20 made in the slide 9 and is fastened on the body 5.

The holding shoe 17 straddles the edges of the slot 20 and is shaped and sized so as to ensure guidance without any noticeable play of the guide bar 4 during longitudinal movements of the guide bar. It has a square shape so as to offer two parallel sides against which the opposite parallel sides of the slot 13 of the guide bar can slide. The portion 13*a* of the slot 13 of the guide bar 4 is meant to slide on the holding and guiding shoe 17. The slot is of a width L, allowing a sliding movement of said guide bar, without any noticeable play, on the parallel sides of said shoe. This width L is 9 mm or greater.

The holding portion 17 serves also as a guiding element for the slide 9.

The functioning of the chain saw adjusting device according to the invention is described below.

Figure 4:
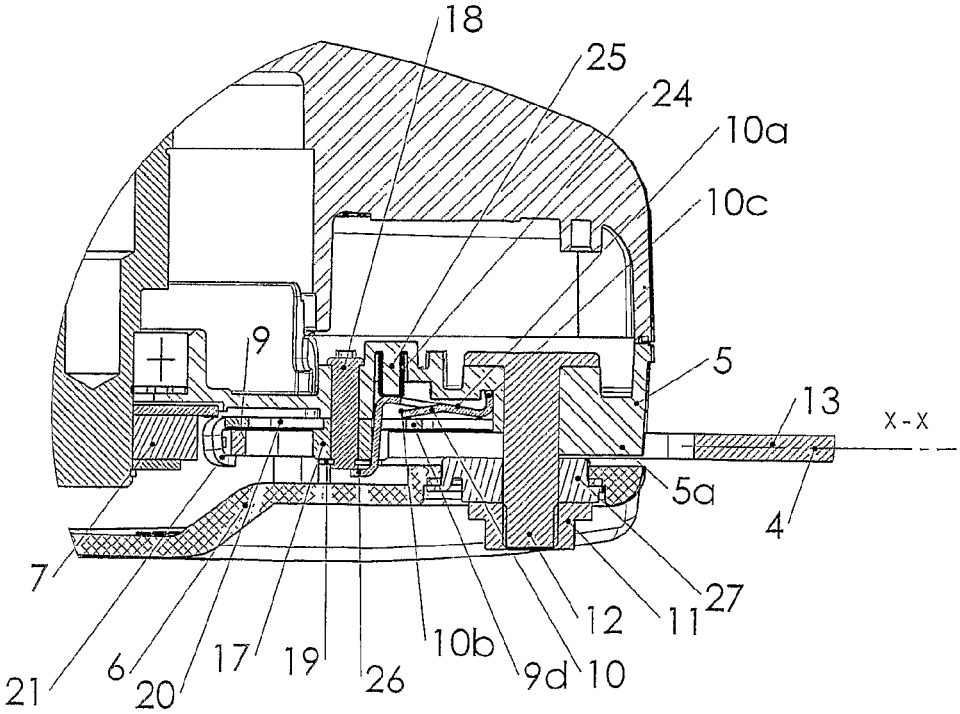
FIG. 4 is a sectional view along plane IV of FIG. 1.

Ready for use, the chain saw 1 is as shown in FIG. 4, on which the guide bar 4 is blocked by the engagement between the body 5 and the jaw 27 slipped over the rod 18 and tightened by the nut 11. The jaw 27 also immobilizes the cover 6 by pressing it against the guide bar 4 and the body 5.

In this position, the retractable retainer 10 has receded in its recess 14 by the front edge or small bar 9*d* of the slide 9 resting against said retainer.

Figure 5:
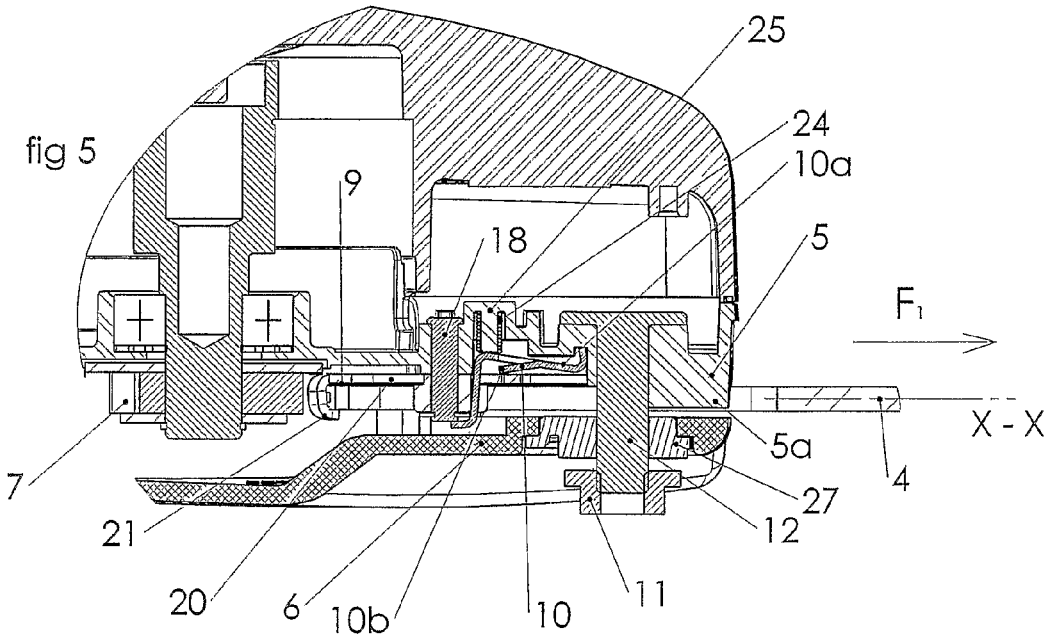
FIG. 5 is a sectional view analogous to FIG. 4, showing the automatic adjustment of the tension of the chain saw of FIGS. 1 and 2.

When the chain 2 is relaxed, its tension is adjusted simply by loosening and then re-tightening the nut 11. This has the advantage of being extremely simple, fast and safe. When the nut 11 is loosened, the spring 8 automatically returns the slide 9 to the front, as illustrated by the arrow F1 in FIG. 5. Thereby this spring 8 re-tensions the chain 2 by stressing the guide bar 4, through the intermediary of the slide 9, in the opposite direction from the drive sprocket 7. The tightness or return force of the spring 8 is selected so that this spring 8 tensions the chains 2 in an optimal manner for the type of work for which the chain saw is intended. In other words, the spring 8 performs automatically an efficient and precise adjustment of the tension of the chain, when the nut 11 is loosened. The subsequent tightening of the screw 11 sets this adjustment by immobilizing the guide 4 again in relation to the sprocket 7.

Figure 7:
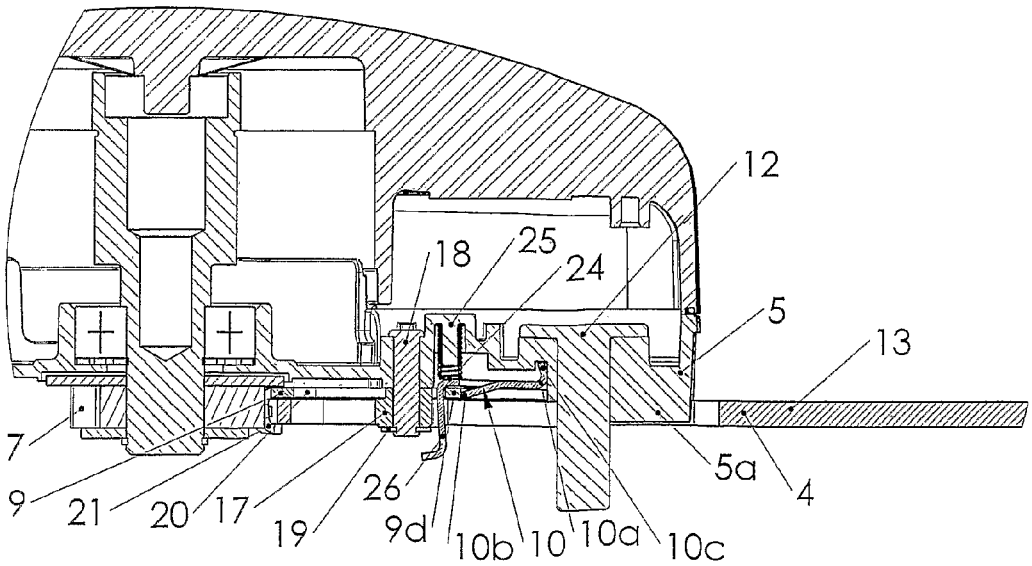
FIG. 7 is a sectional view analogous to FIG. 4, showing another stage of disassembly of the chain of the chain saw of FIGS. 1 and 2.
Figure 6:
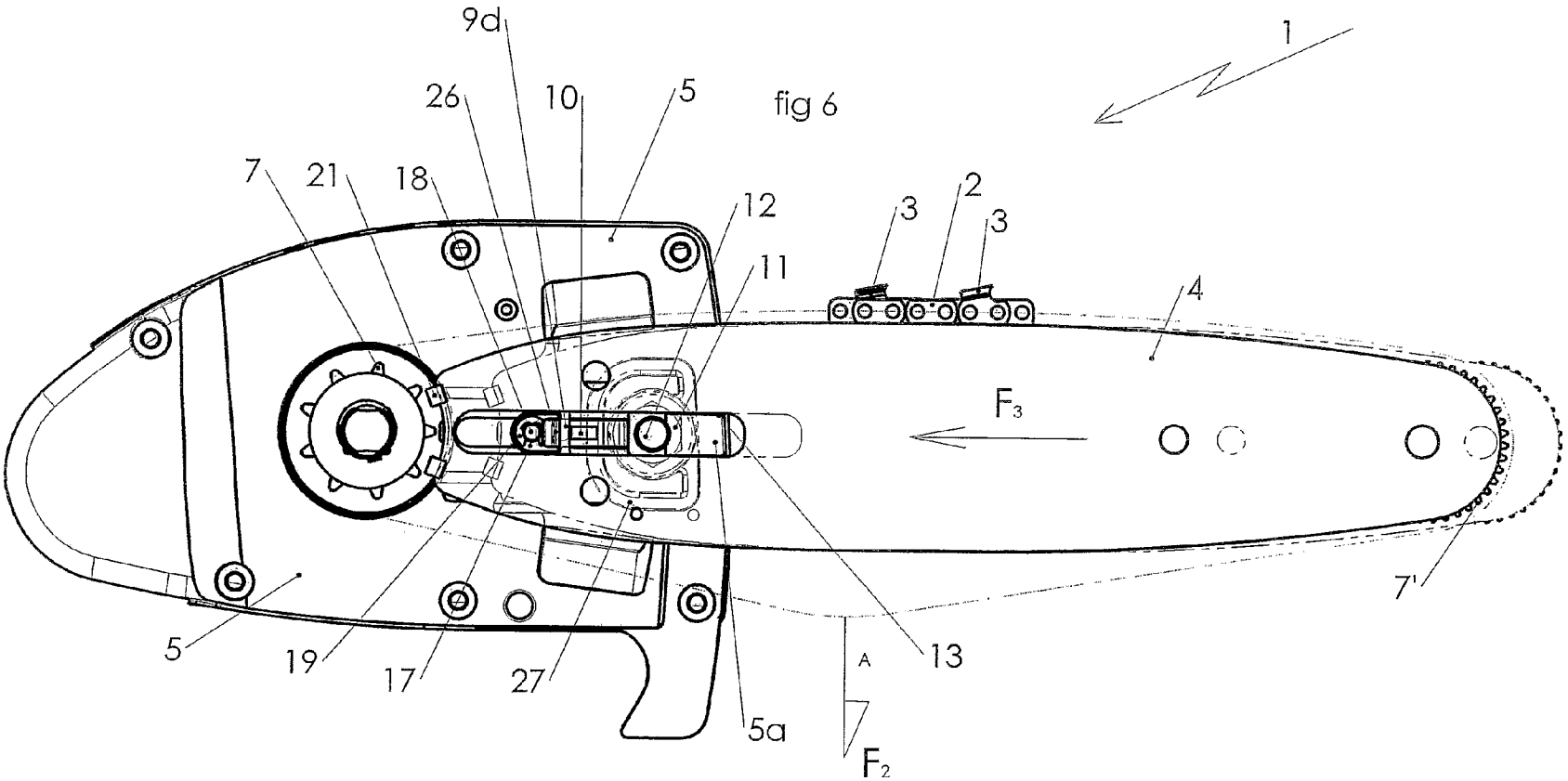
FIG. 6 is a side elevational view which shows a stage of disassembly of the chain saw of FIGS. 1 and 2.
Figure 8:
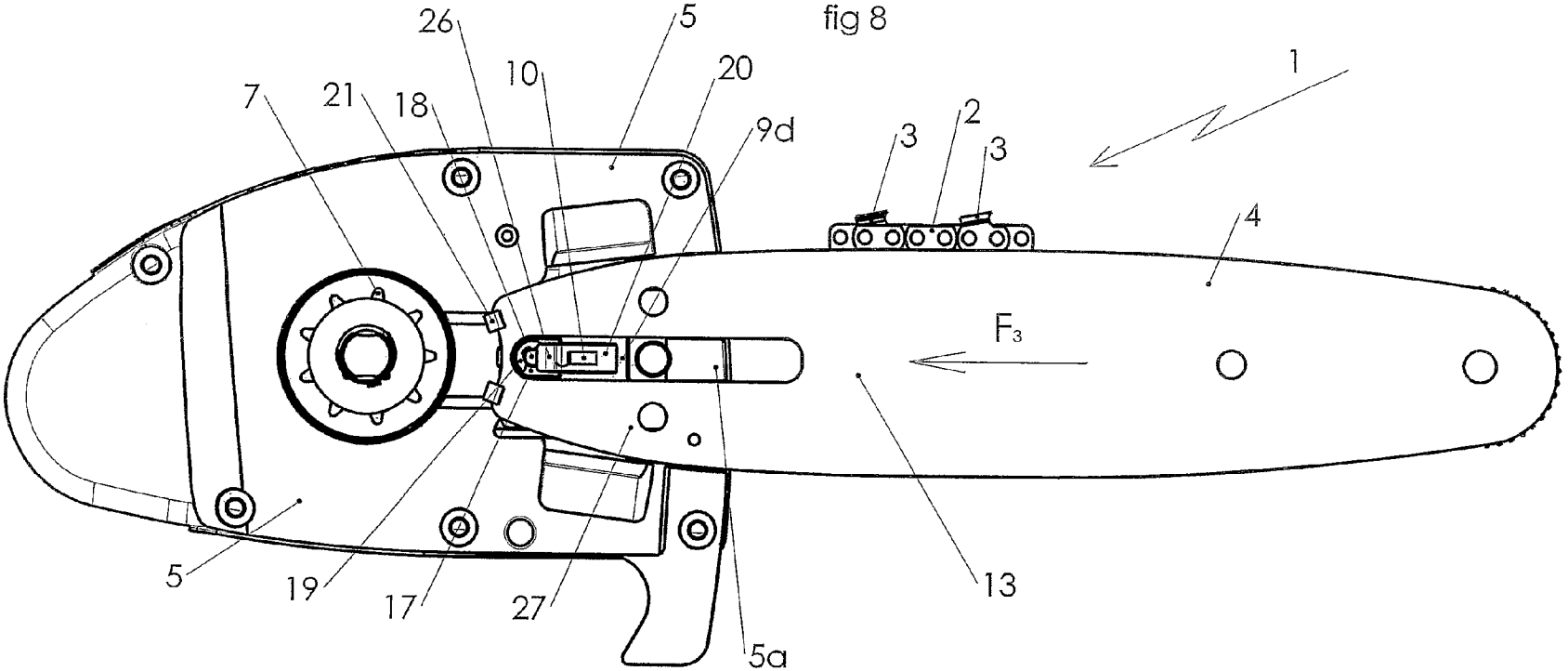
FIG. 8 is a top plan view of the body of the chain saw on which the slide and the retainer catch are shown in a position corresponding to the far position of the guide bar in relation to the drive sprocket.
Figure 9:
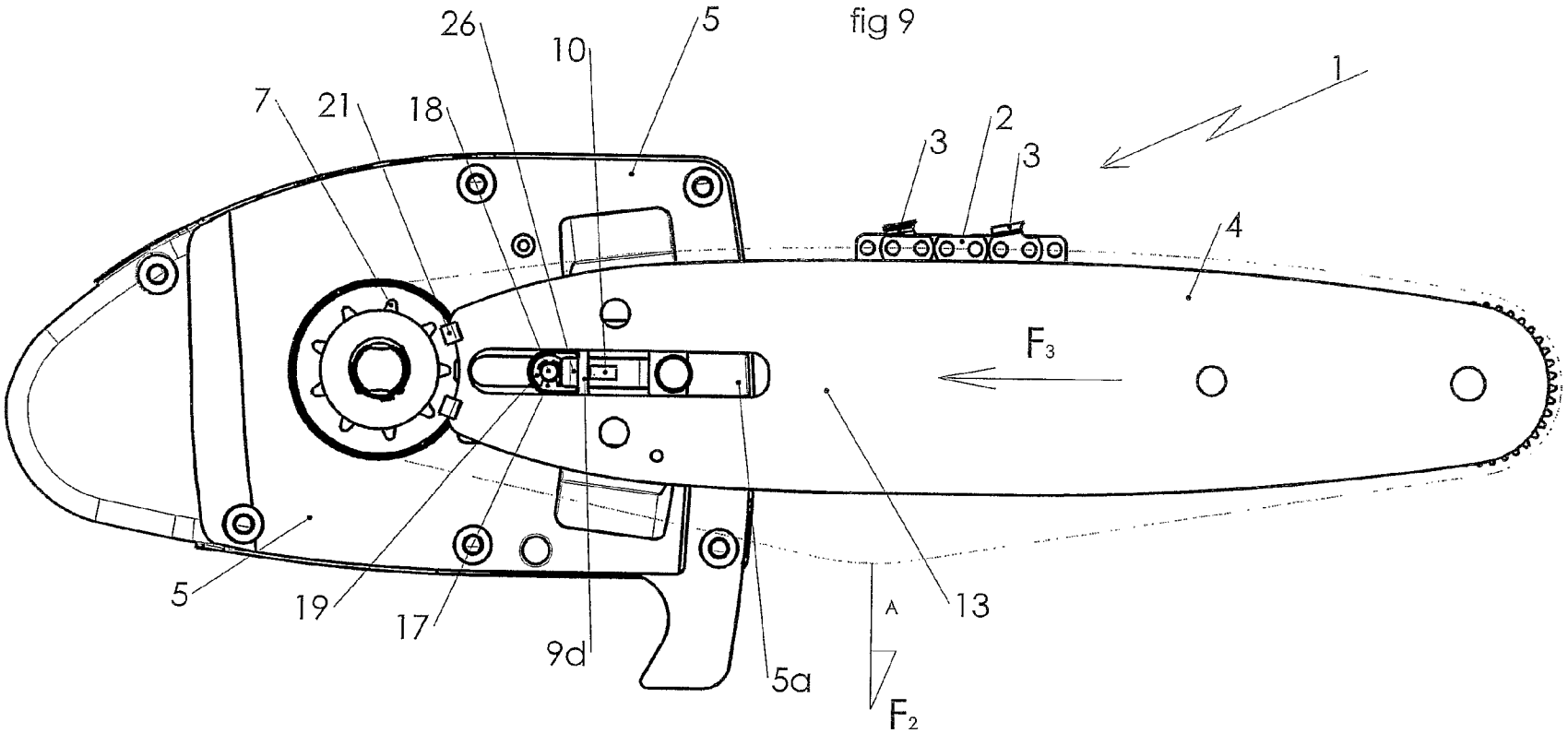
FIG. 9 is a top plan view analogous to FIG. 8, showing said slides and retainer latches in a position corresponding to a near position of the guide bar in relation to the drive sprocket.
Figures 10, 11:
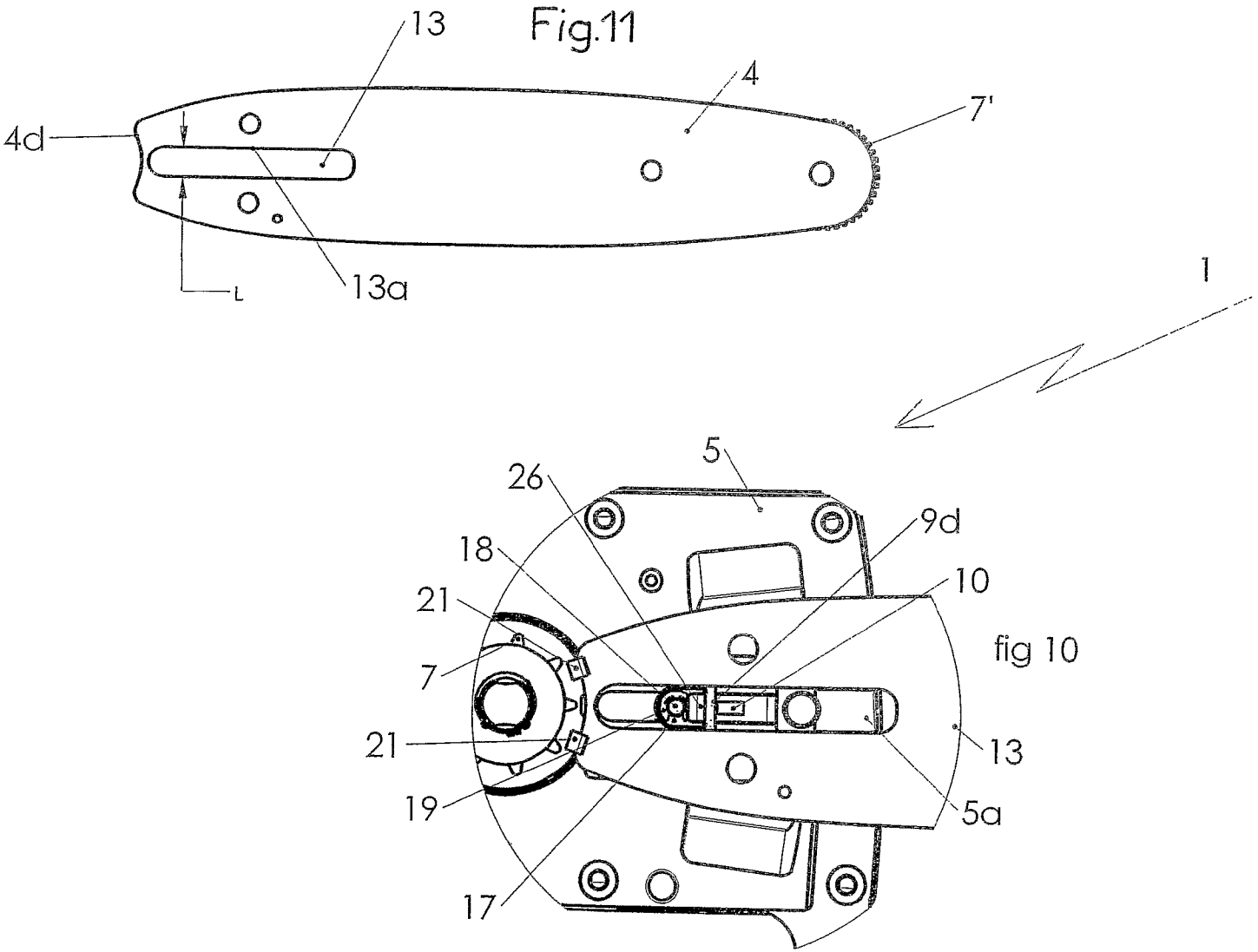
FIG. 10 is a detailed top plan view illustrating more specifically the guidance of the guide bar on the guidance and slide holding shoe.
FIG. 11 is a top plan view of a guide bar equipped of a slot so shaped that it can slide without any noticeable play on two opposing sides of said shoe, being this guided by the latter.

To remove the chain 2, the nut 11 must first be loosened. Then the guide bar 4 is pushed backwards, i.e., towards the drive sprocket 7, in opposition to the counteraction of the spring 8, until the front edge 9*d* of the slide 9 has passed the end 10*b* of the pivoting retainer 10. To do this, one can simply pull sideways on the chain 2, as shown by the arrow F2 in FIG. 6, where the initial position of the guide bar 4 and of the slide 9 is shown in broken lines. The tension F2 applied to the chain 2 moves the guide bar 4 backwards, as shown by the arrow F3 on the same FIG. 6, without requiring a significant or dangerous effort. When the front edge 9*d* of the slide 9 passes the nose 10*b* of the pivoting retainer 10, the spring 24 pivots said retainer into the blocking position shown in FIG. 7, on which said retainer 10 retains the slide 9 by its end 10*b*, in opposition to the action of the spring 8, by preventing any forward movement of said slide.

In this position illustrated in FIGS. 6, 7, 9, and 10, the guide bar 4 has moved backwards, i.e., it is placed in a proximal position closer to the drive sprocket 7, so that the chain 2 is loose and can be removed after removal of the cover 6.

Removal of this chain 2 is then easy and safe, to the extent that the return action of the spring 8 has been canceled out by the retainer 10.

When the chain 2 has been removed, it is possible, if necessary, to easily withdraw the guide bar 4 which the retainer 10 and the slide 9 are still isolating from the return action of the spring 8. This guide bar 4 or any other replacement guide bar 4 can then easily be re-installed, while the retainer 10 still maintains the slide 9 in the backward position.

The removal or installation of the guide bar are facilitated by the provision of the hooks 21 which are wide open towards the front and which are to be found at the distal end of the slide, as previously indicated.

While the slide 9 is still being retained in its backward position, a new chain 2 can easily be installed over the drive sprocket 7 and the guide bar 4. Once this has been done, the cover 6, the jaw 27 and the nut 11 are replaced in position. While this nut 11 is fastened, the cover 6 is pushed towards the body 5 and, through the intermediary of the operating pin 26, pushes the retainer 10 towards its withdrawal position as per FIG. 4, in opposition to the action of the spring 24. The retraction of the retainer 10 releases the slide 9, which is then again pushed forward by the spring 8 and which in turn pulls the guide bar 4 to a tensioning position of the chain 2. After the action of the spring 8 has thus automatically performed the tensioning of the chain 2, the continuation of tightening of the nut 11 leads to the engagement of the jaw 27 on the guide bar 4 which is thus securely immobilized between said jaw 27 and the body 5. The cutting chain is thus in its properly tensioned position. The chain saw is again ready for use.

I claim:

1. A chain saw apparatus comprising:

a body;

a guide bar extending from said body;

a drive sprocket rotatably mounted to said body;

a chain affixed to said drive sprocket and to said guide bar so as to move along said guide bar;

a lossenable engagement device positioned on said body and cooperative with said guide bar so as to allow said guide bar to move in a first direction toward said drive sprocket and in a second direction away from said drive sprocket, said first direction suitable for relaxing tension on said chain, said second direction suitable for tensioning said chain; and a means for automatically pushing said guide bar away from said drive sprocket when said engagement device is loosened, said means for automatically pushing comprising a slide having a rear end resting against a rear end of said guide bar, said pushing means for automatically pushing having an elastic component having one end resting against said body and an opposite end resting against a surface at a front end of said slide.

2. The chain saw apparatus of claim 1, further comprising:

a retractable retainer cooperative with said elastic component so as to immobilize said guide bar in a position adjacent to said drive sprocket.

3. The chain saw apparatus of claim 2, said retractable retainer having a surface abutting said front end of said slide.

4. The chain saw apparatus of claim 2, said retractable retainer being releasable so as to allow said guide bar to move in said second direction.

5. The chain saw apparatus of claim 2, said slide positioned below said rear end of said guide bar, said slide having a rear end having at least one stop-and-catch hook against which rests said rear end of said guide bar, said elastic component of said pushing member bearing against a surface at said front end of said slide, said retractable retainer mounted below said slide so as to immobilize said slide when said slide reaches a limited of a movement thereof.

6. The chain saw apparatus of claim 5, said retractable retainer having an operating pin suitable for releasing said retractable retainer so as to cause said guide bar to move in said second direction.

7. The chain saw apparatus of claim 6, further comprising:

a cover fastened to said body, said operating pin extend toward said cover, said retractable retainer being retracted when said cover bears against said operating pin.

8. The chain saw apparatus of claim 5, further comprising:

a spring bearing against said retractable retainer.

9. The chain saw apparatus of claim 8, said spring being a helical spring being installed in a recess formed in said body below said slide.

10. The chain saw apparatus of claim 8, said body having a guide rod affixed thereto, said spring extending around said guide rod.

11. The chain saw apparatus of claim 5, said stop-and-catch hook having a forward-bent jaw.

12. The chain saw apparatus of claim 1, further comprising:

a fastening rod attached to said body; and a guide shoe mounted at an end of said fastening rod, said slide having a longitudinal slot, said guide shoe extending into said longitudinal slot of said slide so as to maintain said slide on said body, said guide shoe straddling edges of said slot.

13. The chain saw apparatus of claim 12, said guide bar having a longitudinal slot formed at said rear end thereof, said longitudinal slot of said guide bar having a portion slidable on said shoe.

14. The chain saw apparatus of claim 13, said portion of said longitudinal slot of said guide bar having a width of at least 9 millimeters.

15. The chain saw apparatus of claim 1, said body having a contact face bearing against said guide bar, said contact face having a recess, said slide movable in said recess.

* * * * *